US007134916B2

(12) United States Patent
Wang

(10) Patent No.: US 7,134,916 B2
(45) Date of Patent: Nov. 14, 2006

(54) CABLE CONNECTOR WITH IMPROVED TERMINALS

(75) Inventor: Yaojun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,854

(22) Filed: Dec. 1, 2004

(65) Prior Publication Data

US 2005/0142951 A1 Jun. 30, 2005

(30) Foreign Application Priority Data

Dec. 25, 2003 (CN) ..... 2003 2 01235675

(51) Int. Cl.
*H01R 24/00* (2006.01)

(52) U.S. Cl. ..... 439/660; 439/607; 439/701

(58) Field of Classification Search ..... 439/660, 439/106, 98, 497, 579, 903, 606–610, 395, 439/874, 404, 135, 521, 695, 701, 686, 604
See application file for complete search history.

(56) References Cited

U.S. PATENT DOCUMENTS 5,961,351 A * 10/1999 Wu ..... 439/610
6,039,606 A * 3/2000 Chiou ..... 439/610
6,106,338 A * 8/2000 Wu et al. ..... 439/660
6,231,393 B1 5/2001 Lai
6,358,088 B1 3/2002 Nishio et al.
6,722,898 B1 * 4/2004 Peloza et al. ..... 439/108
6,896,529 B1 * 5/2005 Jing ..... 439/135

* cited by examiner

*Primary Examiner*—Truct T. Nguyen
*Assistant Examiner*—Edwin A. Leon
(74) *Attorney, Agent, or Firm*—Wei Te Chung

(57) ABSTRACT

A cable connector (1) includes an insulative housing (10), a number of terminals (20) and a cable (60). The insulative housing includes a base portion (12) and a tongue (14) extending from the base portion. The terminals are received in the insulative housing. Each terminal comprises a contacting portion (21) and an opposite tail portion (22). The contacting portion is located on the tongue, and the tail portion extends beyond the insulative housing. The tail portions of adjacent terminals are different from each other. Each tail portion defines a soldering portion (24) thereon. The cable has conductors (61) soldered to corresponding soldering portions of the tail portions, and the soldering portions are at different height.

8 Claims, 7 Drawing Sheets

CABLE CONNECTOR WITH IMPROVED TERMINALS

BACKGROUND OF THE INVENTION

1. Field of the Invention

The present invention generally relates to an electrical cable connector, and particularly to an electrical cable connector with an improved terminal structure.

2. Description of the Prior Art

Nowadays, the size of electrical cable connectors is required to be reduced to meet the miniaturization requirement of the development of the computer. Since terminals of the electrical cable connector are normally in a same plane, the distance between adjacent terminals is becoming small, and soldering conductors of a cable to the terminals thus becomes more and more difficult.

U.S. Pat. No. 6,358,088 discloses an electrical cable connector having an insulative housing with a plurality of staggered terminal channels, whereby, solder tails of the terminals are staggered with each other. However, the staggered terminal channels are difficult to form and thus increase the production cost.

Hence, it is desirable to have an improved terminal structure to overcome the above-mentioned disadvantages of the prior art.

BRIEF SUMMARY OF THE INVENTION

Accordingly, it is the object of the present invention to provide a cable connector which has improved terminals for facilitating soldering with conductors of a cable.

In order to achieve the above-mentioned object, a cable connector in accordance with the present comprises an insulative housing, a plurality of terminals and a cable. The insulative housing comprises a base portion and a tongue extending from the base portion. The terminals are received in the insulative housing. Each terminal comprises a contacting portion and an opposite tail portion. The contacting portion is located on the tongue, and the tail portion extends beyond the insulative housing. The tail portions of adjacent terminals are different from each other. Each tail portion defines a soldering portion thereon. The cable has conductors soldered to the soldering portions of the tail portions, and the soldering portions are at different height.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
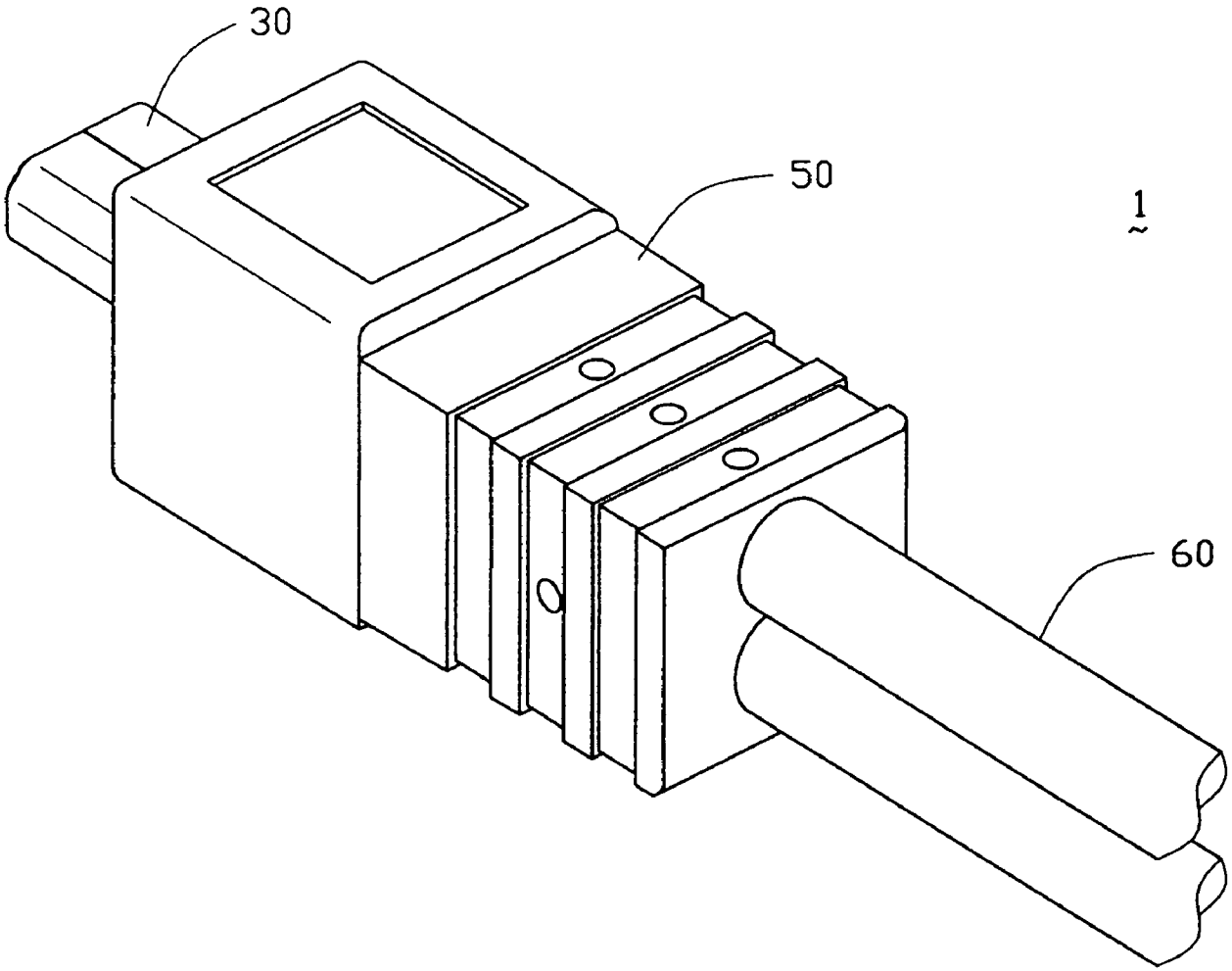
FIG. 1 is a perspective view of a cable connector in accordance with the present invention.

Reference will now be made to the drawing figures to describe the present invention in detail.

Figure 2:
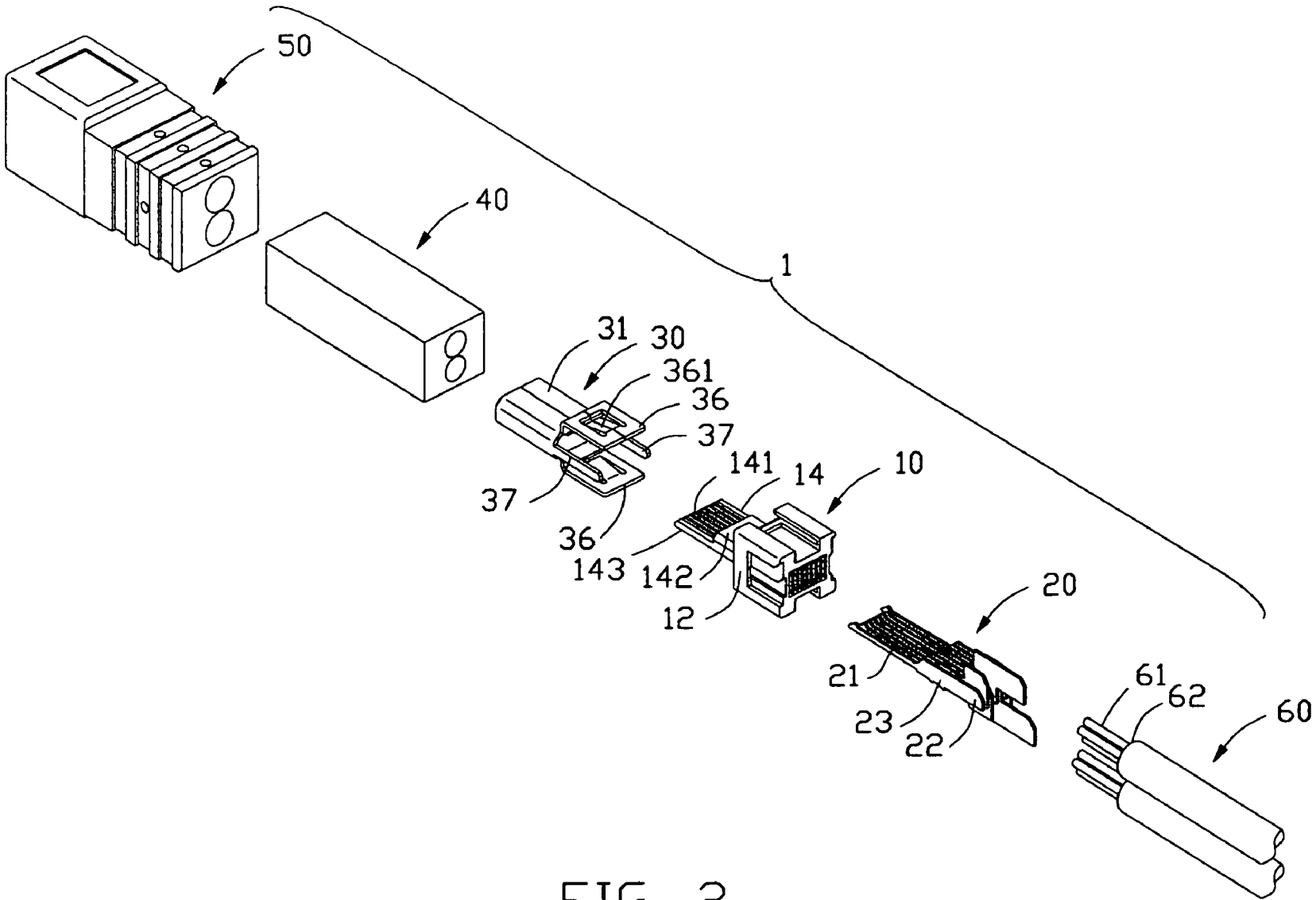
FIG. 2 is an exploded, perspective view of the cable connector shown in FIG. 1.

With reference to FIG. 1 and FIG. 2, a cable connector 1 in accordance with the present invention comprises an insulative housing 10, a terminal set 20 received in the insulative housing 10, a metal shell 30 assembled to the insulative housing 10, an internal insulative shell 40, an external insulative shell 50, and two cables 60.

Figure 3:
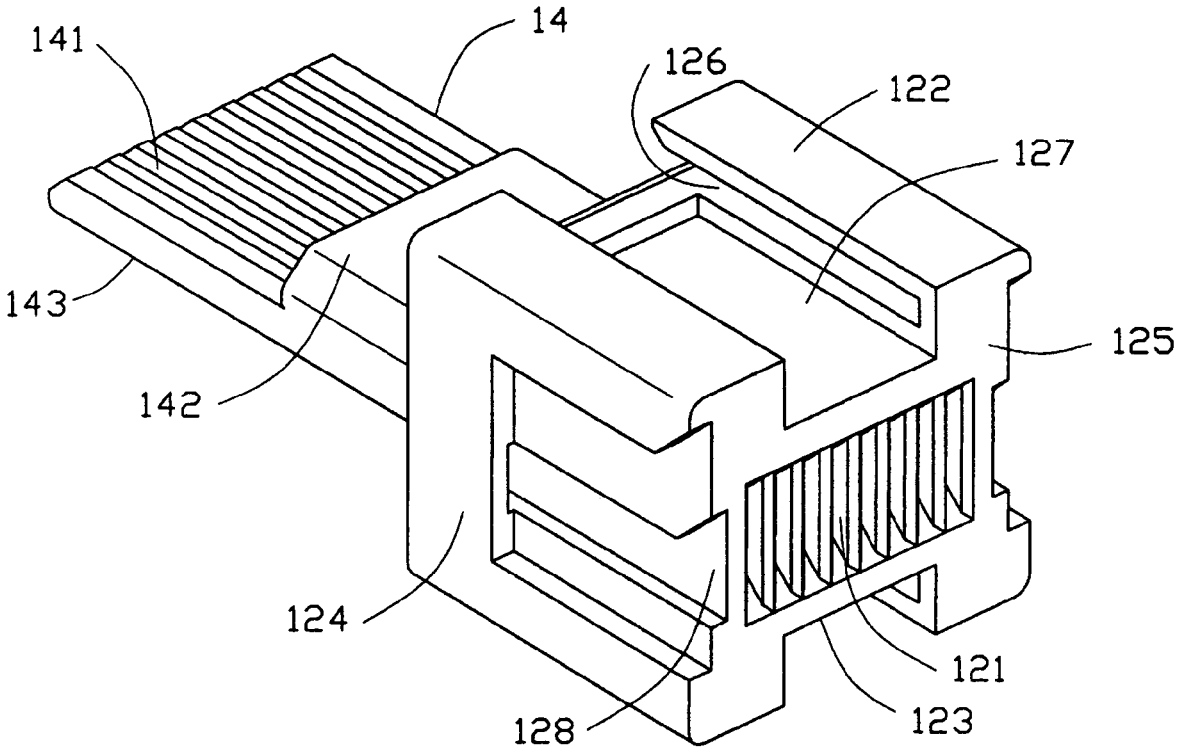
FIG. 3 is a perspective view of a insulative housing of the cable connector shown in FIG. 1.

With reference to FIG. 2 and FIG. 3, the insulative housing 10 comprise a base portion 12 and a tongue 14 extending forwardly from the center of the base portion 12. The base portion 12 comprises a plurality of terminal channels 121 extending therethrough, and a top wall 122, a bottom wall 123 and a pair of side walls 124, 125. The terminal channels 121 arranged in a row and have the same configuration. The top wall 122 has a pair of retaining slots 126 and a depressed portion 127 defined between the retaining slots 126. The bottom wall 123 has a similar structure with the top wall 122. Each side wall 124, 125 defines a passageway 128 extending to a front face of the base portion 12. The tongue 14 comprises a mating portion 143 and a retaining portion 142 next to the mating portion 143. A plurality of terminal slits 141 are defined along the tongue 14 communicating with corresponding terminal channels 121.

Figure 4:
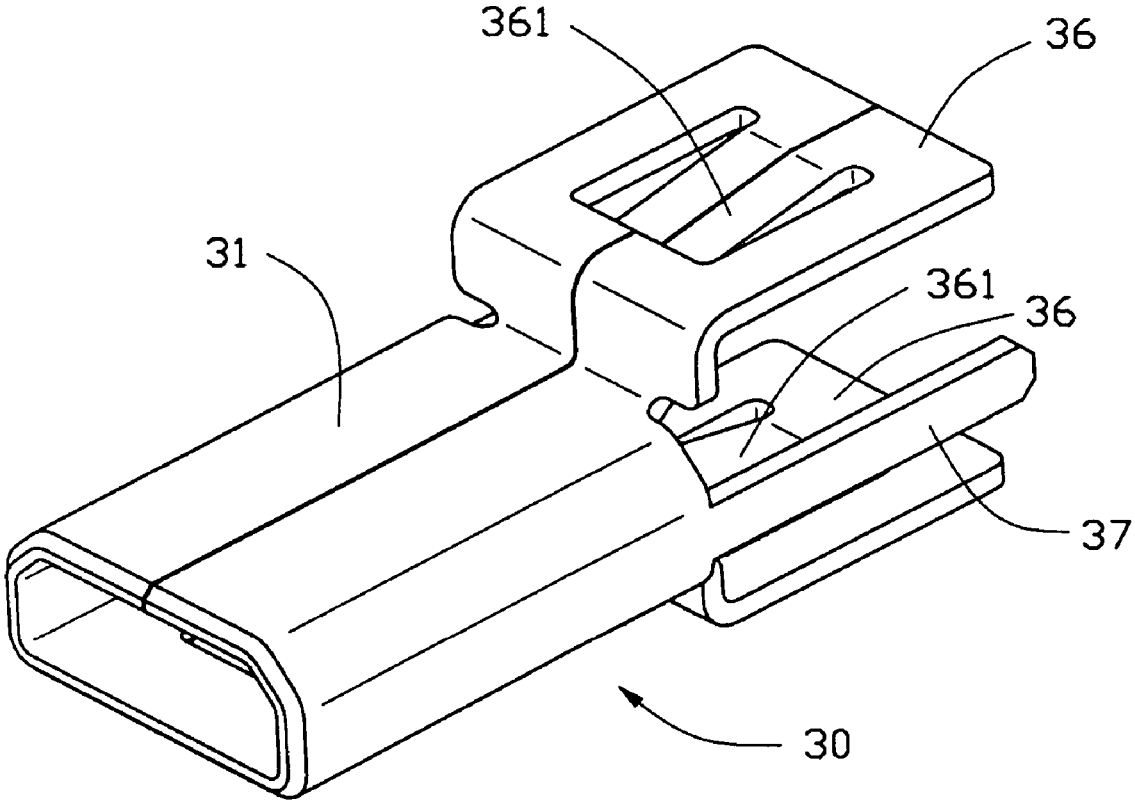
FIG. 4 is a perspective view of a metal shell of the cable connector shown in FIG. 1.

With reference to FIG. 4, the metal shell 30 comprises a main body 31, a pair of retaining portions 36 extending backwardly from upper and lower rear edges of the main body 31, and a pair of arms 37 extending backwardly from rear side edges the main body 31. Each retaining portion 36 defines a resilient clip 361 thereon.

Figure 5:
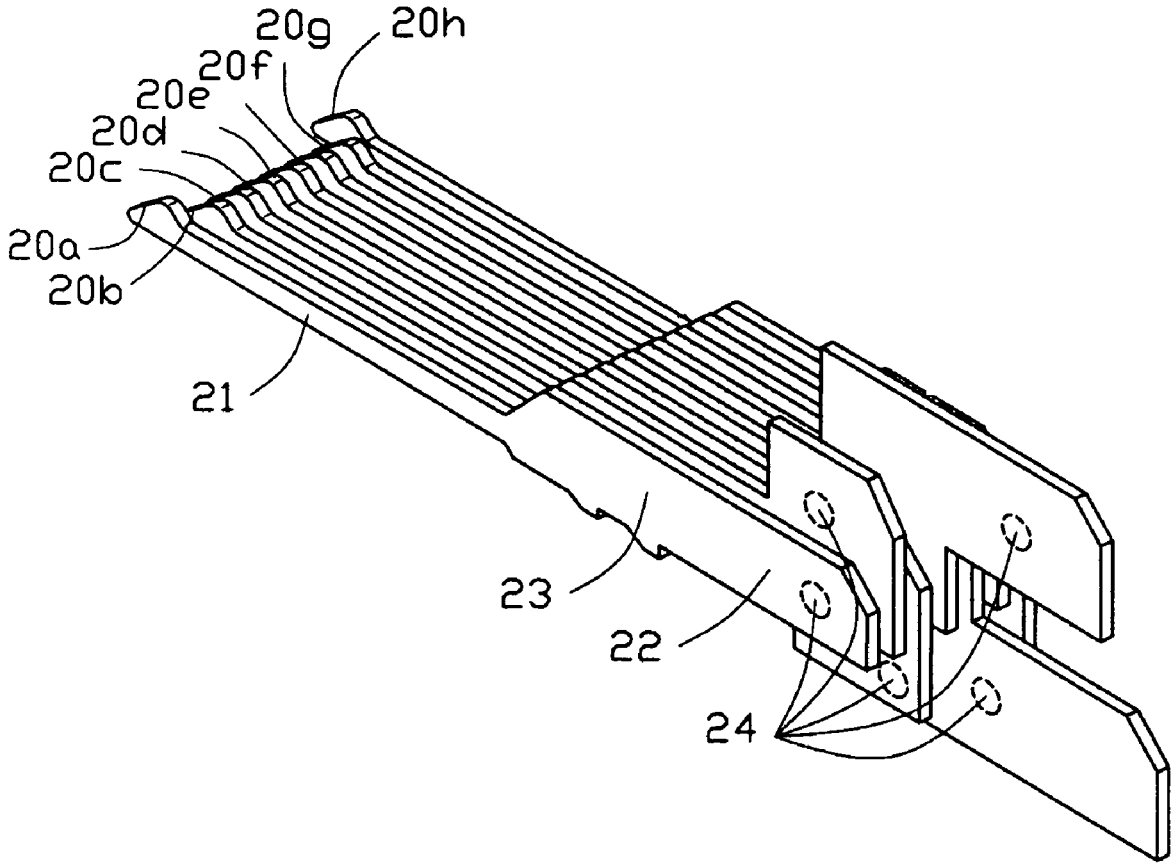
FIG. 5 is a perspective view of a terminal set of the cable connector shown in FIG. 1.

Referring to FIG.5, the terminal set 20 comprises eight terminals labeled by 20*a* to 20*h*, respectively. Each terminal 20 comprises a contacting portion 21 for electrically connecting with a complementary connector (not shown), an intermediate portion 23 extending backwardly from the contacting portion 21, and a tail portion 22 extending backwardly from the intermediate portion 21. The contacting portions 21 and the intermediate portions 23 of the terminal set 20 are in a same plane. The two terminals 20*a*, 20*h* located at opposite sides of the terminal set 20 are power terminals, and the other terminals of the terminal set 20 are signal terminals. The power terminal has a longer contacting portion 21 and the same intermediate portion 23 with the signal terminal. The tail portions 22 of the power terminals 20*a*, 20*h* are the same. Each tail portion 22 of the terminal set 20 defines a soldering portion 24 thereon for connecting with the cables 60. The soldering portions 24 of the signal terminals respectively, extend upwardly, downwardly and backwardly relative to the soldering portions 24 of the terminals 20*a*, 20*h*. The soldering portion 24 of the signal terminal 20*b* is positioned above the tail portion 22 of the power terminal 20*a*. The soldering portion 24 of the signal terminal 20*c* is positioned under the tail portion 22 of the power terminal 20*a*. The soldering portion 24 of the signal terminal 20*d* is positioned behind and above the tail portion 22 of the terminal 20*a*. Similarly, the soldering portion 24 of the terminal 20*e* is positioned under the tail portion 22 of the terminal 20*h*, the soldering portion 24 of the terminal 20*f* is positioned above the tail portion 22 of the terminal 20*h*, the soldering portion 24 of signal terminal 20*g* is positioned behind and under the tail portion 22 of the terminal 20*h*. Accordingly, the soldering portions 24 of the eight terminals 20 are staggered with each other.

Referring back to FIG. 2, each cable 60 comprises an insulative layer 62 and four conductors 61 received in the insulative layer 62.

Figure 6:
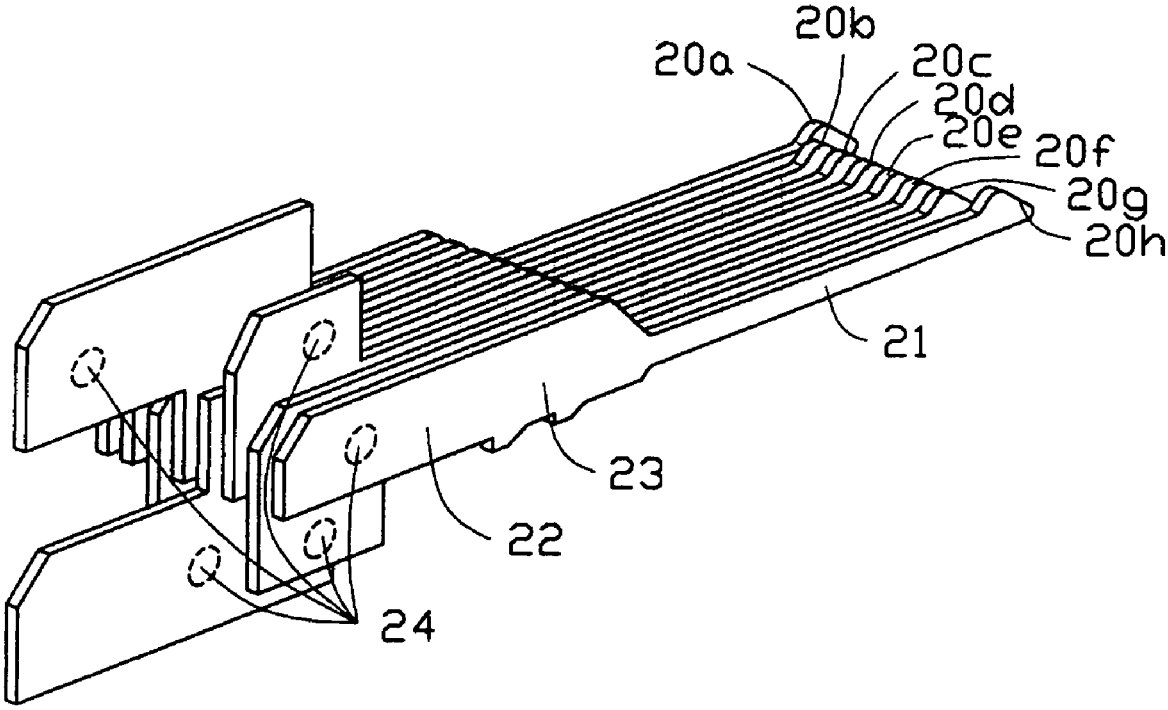
FIG. 6 is another perspective view of a terminal set of the cable connector shown in FIG. 1.
Figure 7:
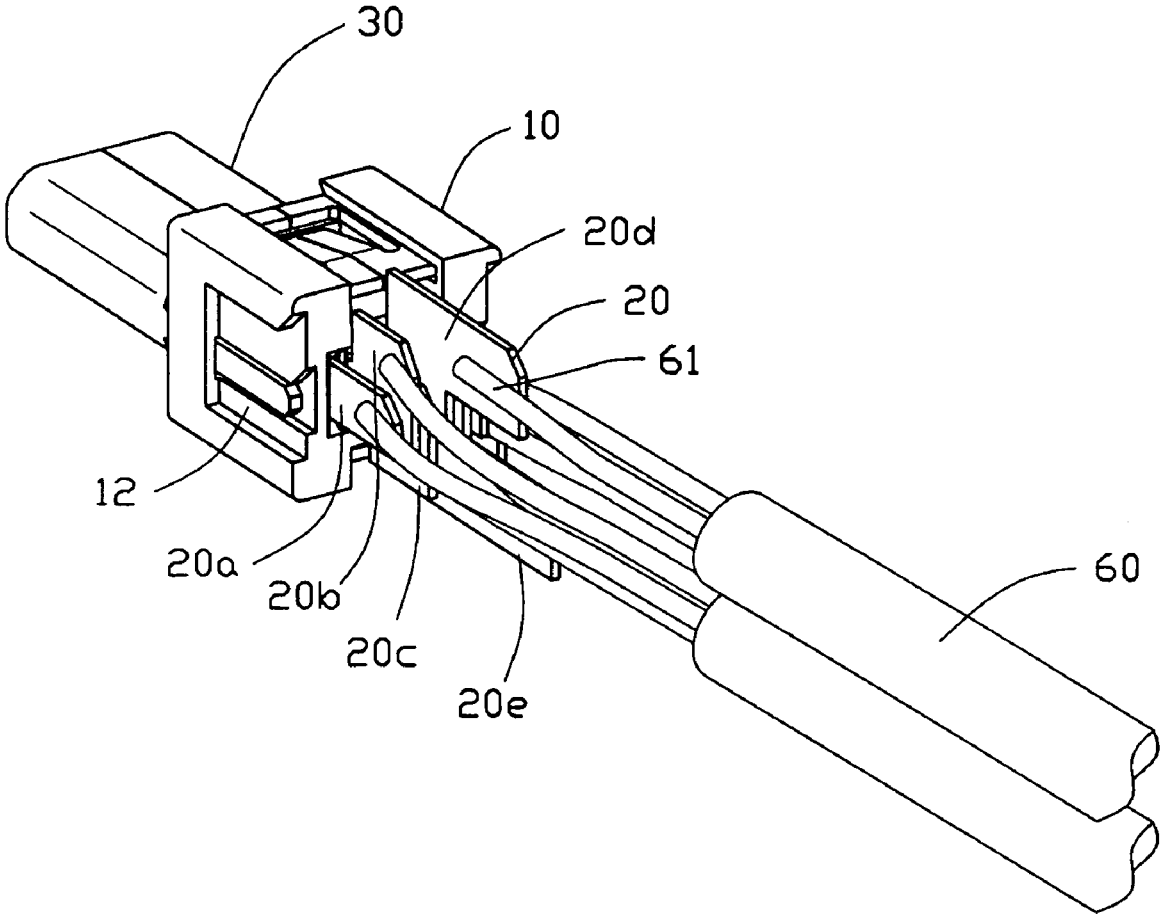
FIG. 7 is a perspective view of the cable connector with an internal insulative shell and an external insulative shell of the cable connector shown in FIG. 1 removed.

In assembly, also referring to FIG. 6, the terminals 20 are inserted into the terminal channels 121 of the insulative housing 10 in a back-to-front direction. The contacting portion 21 of each terminal 20 is received in the terminal slit 141 of the tongue 14, and exposed on the mating portion 143. The intermediate portion 23 of each terminal 20 is located in the retaining portion 142 of the tongue 14. The tail portion 22 of each terminal 20 projects beyond the rear face of the insulative housing 10. The conductors 61 of the cables 60 are soldered to the soldering portions 24 of the tail portions 22 of the terminals 20. The metal shell 30 is assembled on the insulative housing 10 in a front-to-back direction. The retaining portions 36 of the metal shell 30 are engaged with the retaining slots 126 of the insulative housing 10 with the resilient clips 361 thereof engaging with the depressed portions 127. The arms 37 extend into the passageways 128 of the insulative housing 10. The main body 31 of the metal shell 30 encloses the tongue 14 of the insulative housing 10. The internal insulative shell 40 is insert-molded on the base portion 12 of the insulative housing 10, the tail portions 22 of the terminals 20, and the conductors 61 of the cables 60. The external insulative shell 50 is finally over-molded on the internal shell 40 and the cables 60.

As the soldering portions 24 of the tail portions 22 of the terminals 20 are positioned at different height, even the distance between the terminals 20 remains small, the distance between adjacent soldering portions 24 may still be significantly increased. Thus, the conductors 61 of the cable 60 can be easily soldered to the terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector comprising:

an insulative housing comprising a base portion and a tongue extending from the base portion;

a plurality of terminals received in the insulative housing, each terminal comprising a contacting portion and a tail portion opposite to the contacting portion, the contacting portion being received in the tongue of the insulative housing, the tail portion extending beyond the insulative housing, the tail portions of adjacent terminals being different from each other; and a cable having conductors soldered to corresponding tail portions of the terminals at different height;

wherein each terminal comprises an intermediate portion between the contacting portion and the tail portion, the contacting portion and the intermediate portion are in a same vertical plane, each tail portion defines a soldering portion thereon, the soldering portions are arranged at different height;

wherein the terminals comprise a first terminal with its tail portion having the same heigjn as its intermediate portion, a second terminal with its soldering portion above the soldering portion of the first terminal, a third terminal with its soldering portion under the soldering portion of the first terminal, and a fourth terminal with its soldering portion above and behind the soldering portion of the first terminal.

2. The cable connector as described in claim 1, wherein the base portion of the insulative housing comprises a plurality of terminal channels extending therethrough and arranged in a row, the tongue of the insulative housing comprises a plurality of terminal slits communicating with corresponding terminal channels, the contacting portions of the terminals are received in the terminal slits, and the tail portions are received in the terminal channels.

3. The cable connector as described in claim 1, wherein the cable comprises an insulative layer, and the conductors are received in the insulative layer.

4. The cable connector as described in claim 1, wherein the two terminals located at opposite sides of the terminals are power terminals, and the other terminals are signal terminals, the power terminals each having a longer contacting portion than the signal terminals.

5. The cable connector as described in claim 4, wherein the soldering portions of the signal terminals, respectively, extend upwardly, downwardly and backwardly relative to the soldering portions of the power terminals.

6. The cable connector as described in claim 1, further comprising a metal shell, the metal shell comprising a main body, a pair of retaining portions extending backwardly from upper and lower rear edges of the main body, and a pair of arms extending backwardly from rear side edges of the main body, each retaining portion defining a resilient clip therein.

7. The cable connector as described in claim 6, wherein the base portion of the insulative housing comprises a top wall, a bottom wall and a pair of side walls, the top wall define a pair of retaining slots and a depressed portion between the retaining slots, the bottom wall having a similar structure with the top wall, each side wall defining a passageway extending to a front face of the base portion.

8. The cable connector as described in claim 7, wherein the retaining portions of the metal shell are received in the retaining slots of the base portion with the resilient clips thereof engaging with corresponding depressed portions, the arms extending into corresponding passageways of the base portion.

* * * * *